US007296304B2

(12) United States Patent
Goldsborough

(10) Patent No.: US 7,296,304 B2
(45) Date of Patent: Nov. 20, 2007

(54) CRASH HELMET WITH THERMOELECTRIC COOLING

(75) Inventor: Richard Goldsborough, Granbury, TX (US)

(73) Assignee: R & G Machine Tool, Granbury, TX (US)

( * ) Notice: Subject to any disclaimer, the term of this patent is extended or adjusted under 35 U.S.C. 154(b) by 280 days.

(21) Appl. No.: 10/989,007

(22) Filed: Nov. 15, 2004

(65) Prior Publication Data

US 2006/0101556 A1 May 18, 2006

(51) Int. Cl.
*A42C 5/04* (2006.01)

(52) U.S. Cl. ..... 2/171.3

(58) Field of Classification Search ..... 2/171.3, 2/906

See application file for complete search history.

(56) References Cited

U.S. PATENT DOCUMENTS

| | | | | |
|---|---|---|---|---|
| 3,548,415 | A * | 12/1970 | Waters | 2/171.3 |
| 4,470,263 | A | 9/1984 | Lehovec et al. | 62/3 |
| 4,483,021 | A | 11/1984 | McCall | 2/7 |
| 4,944,044 | A * | 7/1990 | Zarotti | 2/413 |
| 5,193,347 | A | 3/1993 | Apisdorf | 62/3.7 |
| 5,655,374 | A * | 8/1997 | Santilli et al. | 62/3.5 |
| 6,081,929 | A * | 7/2000 | Rothrock et al. | 2/171.3 |
| 6,122,773 | A * | 9/2000 | Katz | 2/171.3 |
| 6,125,636 | A | 10/2000 | Taylor et al. | 62/3.5 |
| 6,430,935 | B1 * | 8/2002 | Klett et al. | 62/3.3 |
| 6,438,964 | B1 | 8/2002 | Giblin | 62/3.5 |
| 6,510,696 | B2 | 1/2003 | Guttman et al. | 62/3.3 |
| 6,516,624 | B1 * | 2/2003 | Ichigaya | 62/259.3 |
| 6,760,925 | B1 * | 7/2004 | Maxwell | 2/171.3 |
| 2001/0052343 | A1 * | 12/2001 | Reedy et al. | 128/204.15 |
| 2004/0074250 | A1 * | 4/2004 | Junkins | 62/259.3 |
| 2006/0053529 | A1 * | 3/2006 | Feher | 2/171.3 |

FOREIGN PATENT DOCUMENTS

| | | | |
|---|---|---|---|
| CA | 2171265 | | 3/1996 |
| DE | 0 818 156 | | 1/1998 |
| JP | 04163305 | A * | 6/1992 |
| JP | 2000-234213 | | 8/2000 |
| JP | 2000234213 | A * | 8/2000 |
| JP | 2003336120 | A * | 11/2003 |
| JP | 2004270087 | A * | 9/2004 |

* cited by examiner

*Primary Examiner*—Katherine Moran
(74) *Attorney, Agent, or Firm*—Charles D. Gunter, Jr.

(57) ABSTRACT

An conditioning system is shown for a helmet having an impact resistant body with an exterior, an interior which defines a head receiving cavity, a front region and having a back region which is located adjacent a lower edge of the helmet body. A first opening is provided in the helmet body located at the back region of the helmet body adjacent a lower edge thereof which acts as an air intake opening. A blower fan communicates with the air intake passage for drawing air into the intake passage and forcing the air from the back region of the helmet in the direction of the front region thereof. A thermoelectric cooling element is located in the helmet interior in communication with the intake passage downstream of the blower fan. The thermoelectric cooling element has a cold side and a hot side. A DC power source is provided for powering the thermoelectric cooling element. An external heat sink is located on the helmet exterior and is connected to the hot side of the thermoelectric cooling element by means of a second opening in the helmet body. Air passing over the thermoelectric cooling element is cooled and air conditions the head receiving region of the helmet.

18 Claims, 3 Drawing Sheets

CRASH HELMET WITH THERMOELECTRIC COOLING

BACKGROUND OF THE INVENTION

1. Field of the Invention

The present invention relates generally to crash helmets such as motorcycle helmets and, more specifically, to such a helmet having a built in air conditioning module which provides cooling and temperature control for the inside of the helmet.

2. Description of the Prior Art

A variety of "crash" type helmets are known in the prior art for use in a variety of different industries or avocations. Generally speaking, the helmet is used to protect the head of the wearer by preventing major impacts, thereby serving to safeguard the well being of the wearer. For example, such helmets are commonly used by motorcycle enthusiasts and stock car and race car drivers. For purposes of the present discussion, a motorcycle embodiment of the invention will be described. However, it will be understood that other type crash helmets can also benefit from the improved design of the invention.

While various styles of helmets are commercially marketed, they all tend to cover the entire head by a non-porous shell made of a plastic acrylic or other suitable synthetic type material. Since the wearer's head emits heat, this can cause discomfort or even unsafe wearing conditions. For example, heat which is trapped within the helmet interior can cause the visor to fog and obscure vision. Sweat dripping down in the wearer's face can also be distracting and obstruct the vision of the wearer.

To solve this problem, helmet manufacturers have tended to provide vents or air intake openings in the helmets, typically in the front portion of the helmet facing the oncoming air flow while driving. Canadian Patent Application No. 2,171,265, entitled "Motor Cycle Helmet", by Tsai, discusses this type helmet design and alternative designs. The previously described air intake openings can allow water to enter the helmet when it is raining outside. Even if a movable closure plate is present, closing the intake vent causes the interior to steam up and create a stuffy, hot feeling. Tsai goes on to describe alternative designs utilizing "conducting devices" and "opening and closing regulating heat sinks". However, these alternative designs suffered from various shortcomings such as poor interior circulation, allowing rain and water to seep in. Certain of the designs were complicated to implement, requiring the assembly of many parts.

Tsai addressed the problem of interior helmet heating by providing an improved "ventilating" system. Although the exact nature of the ventilating system is not fully apparent from the brief written disclosure, it appears that a pair of exhaust and intake fans on the rear of the helmet work in conjunction with an intake port on the front of the helmet. The intake and exhaust fans draw incoming air across a thermoelectric cooling element with the cooled air being circulated through ventilating ducts to the helmet interior. The intake port on the front of the helmet would continue to allow rain and moisture to accumulate in the helmet interior. Also, the thermoelectric cooling component design was not of an optimum design to provide the optimum cooling effect for the helmet interior.

SUMMARY OF THE INVENTION

The present invention has as its object to provide further improvements in cooling systems for crash helmets such as motorcycle helmets.

A further object of the invention is to provide such a helmet cooling system having improved air flow and having an improved thermoelectric module arrangement which provides more efficient interior cooling than was previously available.

Another object of the present invention is to provide an improved heat sink arrangement and an improved packaging arrangement for the components of the cooling system of the invention.

These and other objects of the invention are achieved through a helmet air conditioning system for a helmet having an impact resistant body with an exterior, an interior which defines a head receiving cavity, a front region and having a back region which is located adjacent a lower edge of the helmet body. A first opening is provided in the helmet body located at the back region of the helmet body adjacent the lower edge thereof. The first opening defines an air intake passage for the intake of external air. At least one blower fan communicates with the air intake passage for drawing air into the intake passage and forcing the air from the back region of the helmet in the direction of the front region thereof. A thermoelectric cooling element is located in the helmet interior in communication with the intake passage downstream of the blower fan. The thermoelectric cooling element has a cold side and a hot side. A power source is provided for powering the thermoelectric cooling element. An external heat sink is located on the helmet exterior, the external heat sink being connected to the hot side of the thermoelectric cooling element by means of a second opening in the helmet body.

Preferably, the helmet interior has a styrofoam liner installed therein which has a plurality of air conditioning ducts formed therein in communication with the air intake passage, whereby air forced from the rear of the helmet through the air intake passage is forced through the air conditioning ducts into the head receiving cavity in the interior of the helmet body. In the preferred embodiment of the invention, the external heat sink located on the helmet exterior is a thin, curved strip having a length and a width and which wraps around a portion of the helmet exterior extending from the back region of the helmet body toward the front. Preferably, the heat sink has a length which is at least twice its width.

Since air is being drawn in from the rear region of the helmet and forced through the air intake passage toward the air conditioning ducts in the helmet interior, the helmet body is preferably devoid of any air intake openings in the front of the helmet body.

The blower fan, thermoelectric cooing element, heat sink and power source can be supplied as components in kit form, whereby a user can install the air conditioning components in a stock crash helmet.

Additional objects, features and advantages will be apparent in the written description which follows.

DETAILED DESCRIPTION OF THE INVENTION

Figure 1:
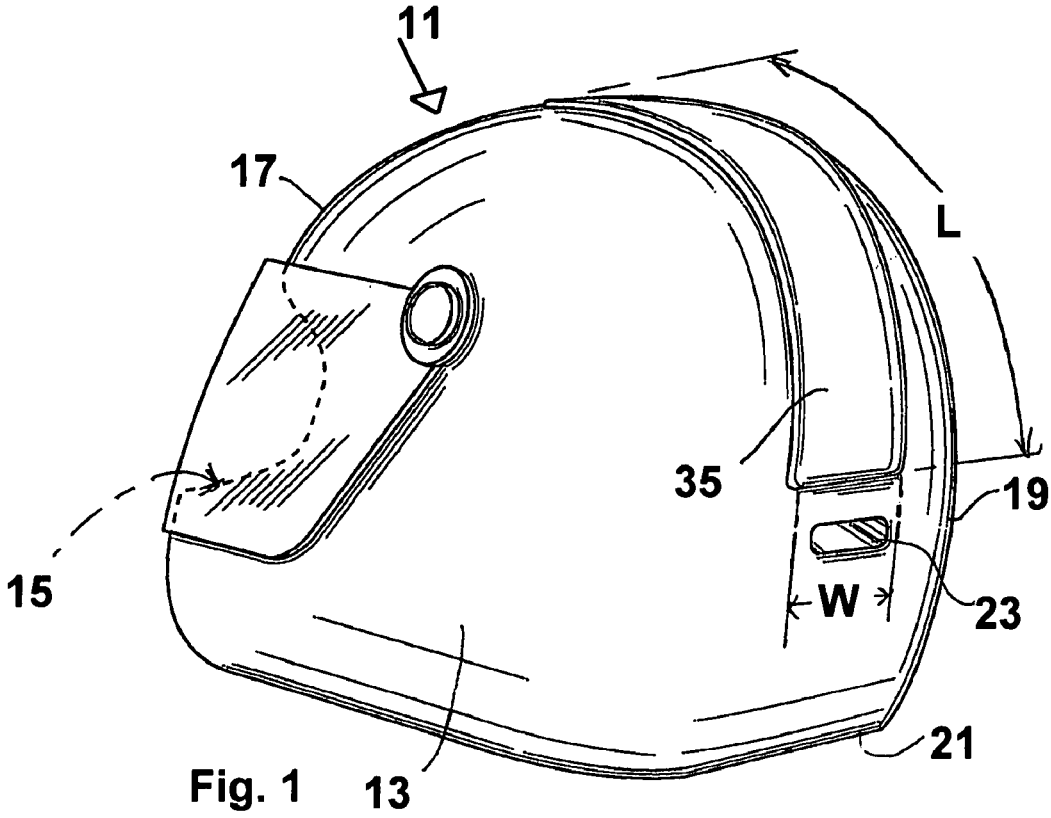
FIG. 1 is a rear, perspective view of one preferred embodiment of the air conditioned crash helmet of the invention.

Turning to FIG. 1, there is shown an air conditioned crash helmet 11 of the invention. The helmet 11 is formed from an impact resistant body having an exterior 13, an interior 15 which defines a head receiving cavity, a front region 17 and having a back region 19 which is located adjacent a lower edge 21 of the helmet body. The helmet body can be formed of any convenient material, typically a synthetic plastic or acrylic plastic. One advantage of the present invention is that a stock crash helmet, such as a motorcycle helmet, can be fitted with the air conditioning system of the invention.

Figure 3:
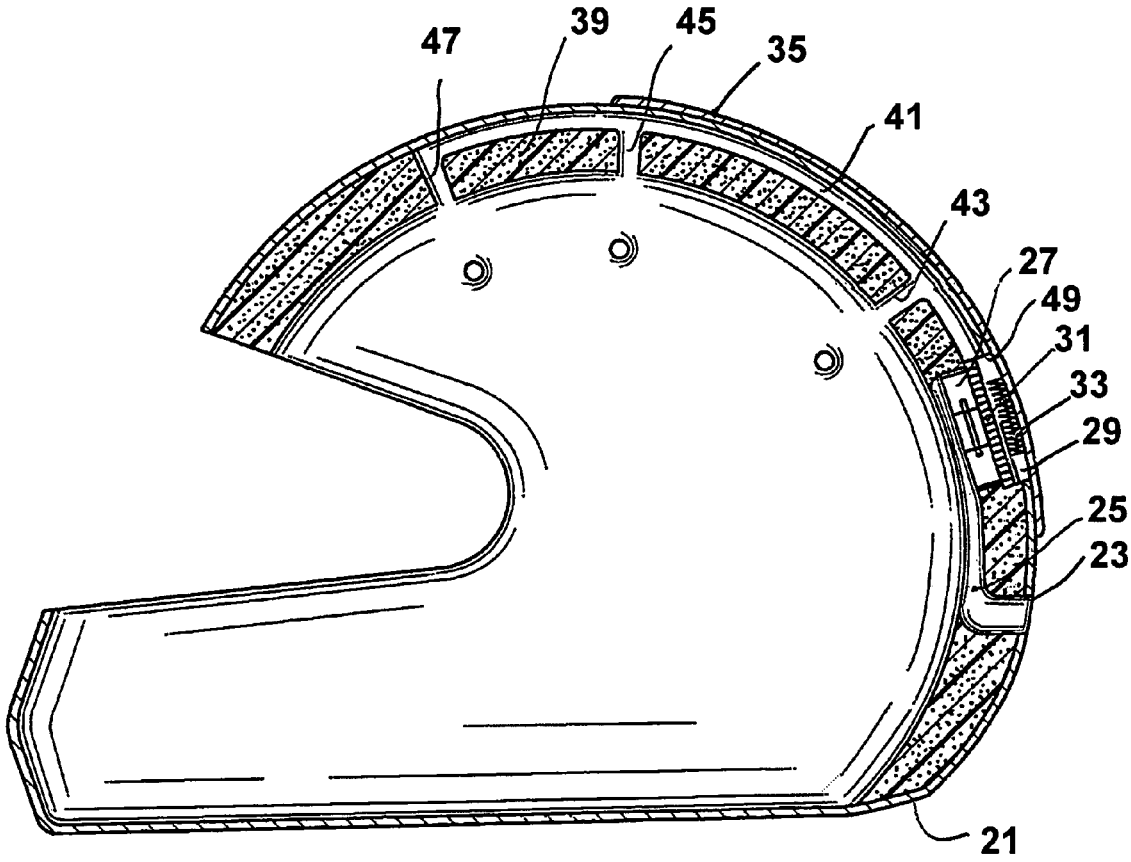
FIG. 3 is a side, cross sectional view of the helmet of FIG. 1, taken approximately along the mid section thereof.

As best seen in FIG. 3, a first opening 23 is formed in the helmet body located at the back region 19 thereof adjacent the lower edge 21. The first opening 23 defines an air intake passage 25 for the intake of external air.

In the embodiment of the invention shown in FIG. 3, at least one blower fan 27 communicates with the air intake passage 25 for drawing air into the intake passage 23 and forcing air from the back region 19 of the helmet in the direction of the front region 17 thereof. The blower fan 27 is a commercially available 6500 to 11,500 rpm DC fan which runs quietly on a miniature motor.

A thermoelectric cooling element 29 is located in the helmet interior in communication with the intake passage 25 downstream of the blower fan 27. The thermoelectric cooling element 29 has a cold side 31 and a hot side 33. Preferably, the thermoelectric cooling element is a Peltier type module. The Peltier effect has been used in heat pumps and heat exchangers for heating and cooling of spaces and materials in a variety of circumstances. Whether used to heat or cool, depends on the polarity of the electrical energy supplied to the thermoelectric module by conductors. When one side of the Peltier thermoelectric module is energized, it will become hot and the other side will become cold. For the purposes of the present invention, the module is arranged with the cold side in heat conductive association with the air intake passage and blower fan. The hot side is thermally associated with an external heat sink 35 which is located on the helmet exterior. Peltier elements of the type under consideration are available from a number of commercial sources including Marlow Industries, Inc., of 10451 Vista Park Road, Dallas, Tex. The Peltier element is powered by a suitable DC power source, such as the conventional cigarette lighter adapter 37 shown in FIG. 4.

As best seen in FIG. 3, the helmet interior 15 has a porous liner 39 installed therein. The liner is typically formed of a polystyrene, a polyurethane or similar lightweight expanded plastic or synthetic. As shown in FIG. 3, the liner 39 of the invention has a plurality of air conditioning ducts formed therein in communication with the air intake passage 25, whereby air forced from the rear of the helmet through the air intake passage is forced through the air conditioning ducts into the head receiving cavity in the interior 15 of the helmet body. In the embodiment of the invention shown in FIG. 3, the ducts include both longitudinally extending branches 41 and radial branches 43, 45 and 47. Also as shown in FIG. 3, an external heat sink 35 is located on the helmet exterior and is connected to the hot side 33 of the Peltier element by means of a second opening 49 in the helmet body.

As best seen in FIG. 1, the external heat sink 35 which is located on the helmet exterior is a thin, curved strip having a length "l" and a width "w" and which wraps around a portion of the helmet exterior extending from the back region 19 toward the front region 17. In the preferred embodiment of the invention shown, the external heat sink 35 has a length which is at least twice its width and which preferably has length which is about three or more times its width. The heat sink 35 can be glued, bolted or otherwise affixed to the helmet exterior or can be fitted in a groove or recess on the helmet exterior. The heat sink 35 is preferably a continuous strip with a low profile for aeronautic efficiency.

Figure 2:
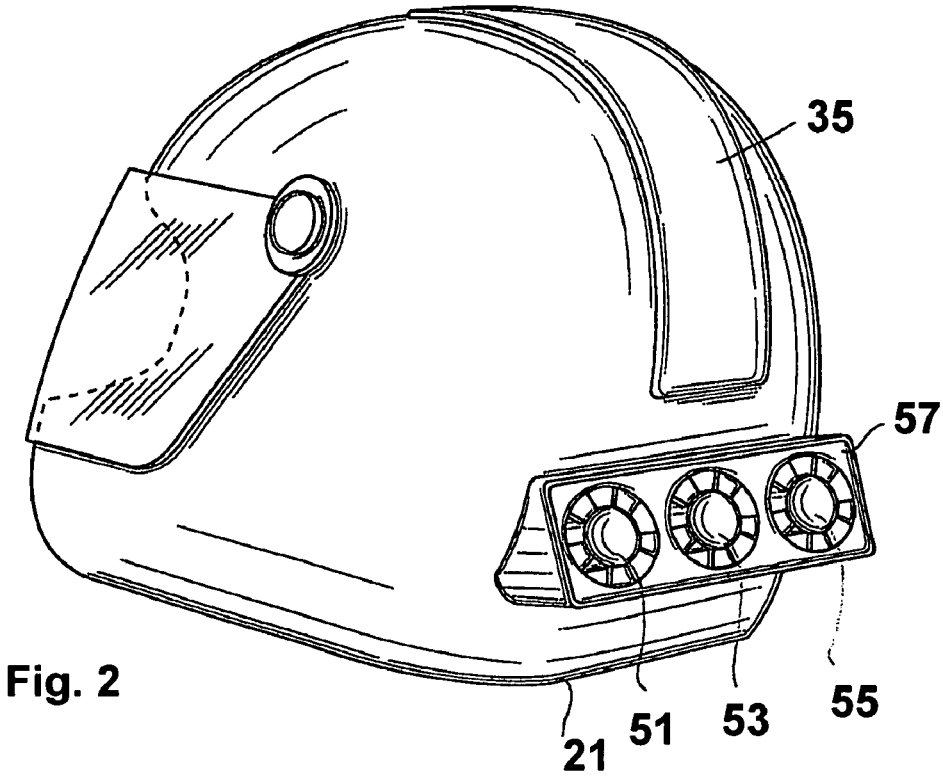
FIG. 2 is a rear perspective view, similar to FIG. 1, of another embodiment of the crash helmet of the invention.

FIG. 2 shows another embodiment of the invention in which one or more blower fans, 51, 53, 55 are mounted in an external volute 57. As can be seen in FIG. 2, the volute 57 is formed on the back region of the helmet body adjacent the lower edge 21. The volute 57 forms a blower fan housing which communicates with the air intake passage (25 in FIG. 3) for drawing air into the intake passage and forcing air from the back region of the helmet in direction of the front region thereof. The internal configuration of the helmet having the volute 57 is generally similar to the cross-sectional view of FIG. 3 with the exception that the internal blower fan component 27 is not required. Otherwise, the Peltier element, heat sink and air conditioning ducts could be identical. The volute 57 would typically be provided as a separate injection molded part which could be glued or otherwise affixed to the helmet exterior.

While the embodiment of the invention shown in FIG. 2 differs from that of FIG. 1 in requiring the external volute 57, both embodiments of the invention work in the same way in that external air is drawn into the intake passage 25 and forced by the blower fans over the thermodynamic cooling element and out the air conditioning ducts 41, 43, 45 and 47. It is not necessary to have a front air intake opening in the helmet.

Figure 4:
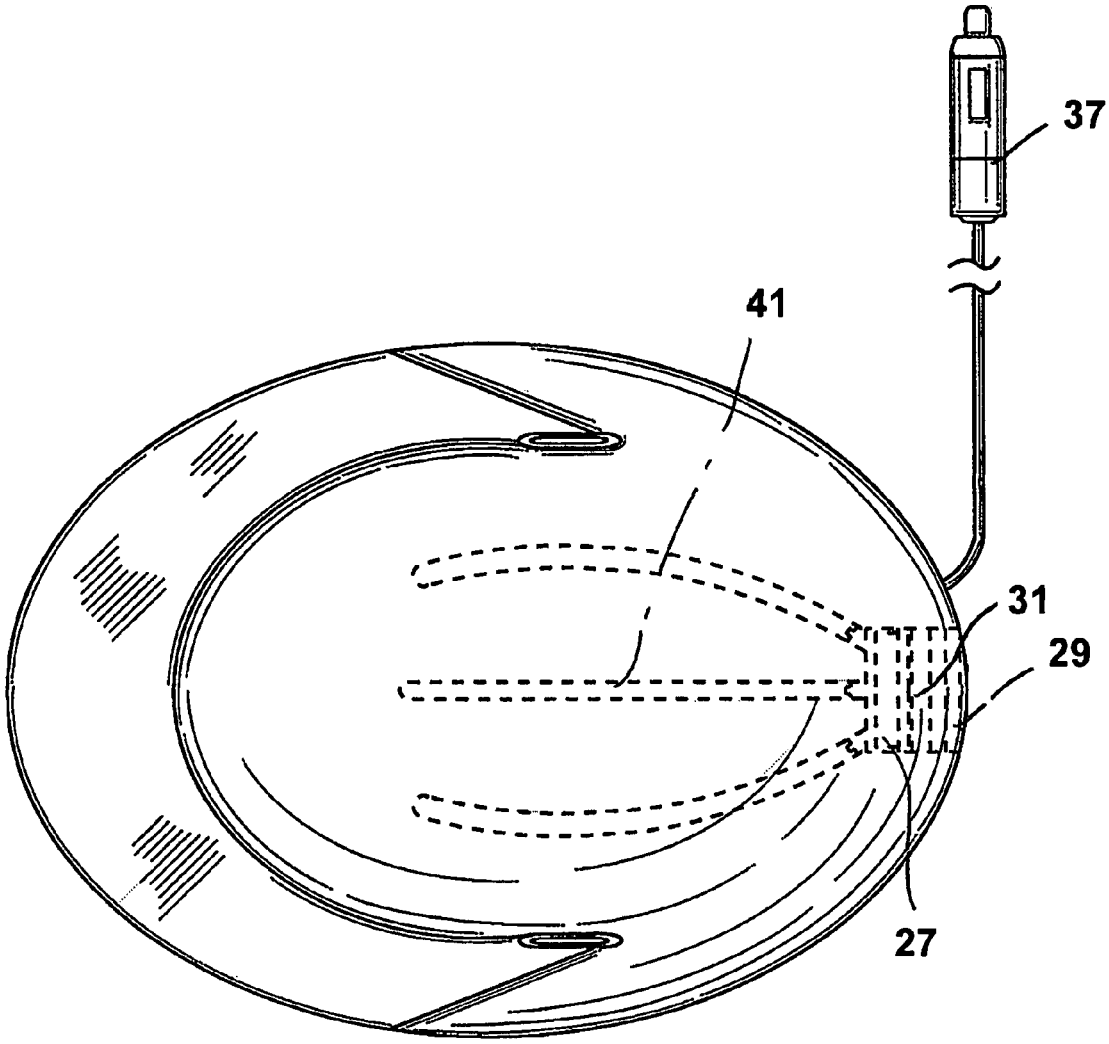
FIG. 4 is a top view of the helmet of FIG. 1, showing the air conditioning ducts and certain of the internal components in dotted lines.

FIG. 4 is a top view of the preferred embodiment of FIG. 1 showing the air conditioning ducts 41, the blower fan 27 and the cold and hot sides 29, 31, respectively of the thermoelectric cooling element. The twelve volt cigarette lighter adapter plug 37 is used to power the blower fans. In the case of the external volute shown in FIG. 2, the three fans are typically each 6500 to 11,500 rpm DC fans which run quietly at about 28 to 47 cubic feet per minute.

While the invention has been illustrated in FIGS. 1 and 2 as a factory installed air conditioned helmet, the improved air conditioning system of the invention can also be provided in the form of kit components which can be added on by the user after purchase. In other words, the blower fan, thermoelectric cooling element, heat sink and power source could be supplied as components in kit form, whereby a user could install the air conditioning components in a stock crash helmet. In order to retrofit the helmet, a first opening (23 in FIG. 1) would be drilled or cut in the helmet body at the back region of the helmet. Another opening (49 in FIG. 3) would be cut or bored through the helmet shell slightly spaced above the first opening for the air intake passage. The internal shell liner 39 which is typically formed of styrofoam, polyurethane, or similar materials, would be removed and the air conditioning ducts 41, 43, 45, 47, the air intake passage 25 and the openings for the Peltier element and fan blower would be cut in the liner material. The internal components of the air conditioning system would then be fitted in the liner and the liner reinstalled in the helmet. The hot side 33 of the thermoelectric cooling element would be affixed to the external heat sink 35 and the heat sink would be either glued, bolted or otherwise secured to the exterior of the helmet.

An invention has been provided with several advantages. The air conditioned crash helmet of the invention uses cooling components which are simple in design and economical to manufacture and which are easily commercially available. The design features a "forced draft" airflow in which a rearwardly located air intake passage draws in air from the outside with the air being forced by a blower fan through air conditioning ducts towards the forward portion and head receiving cavity of the helmet. Because the design utilizes a rear air intake and a forced draft blower, there is no requirement for openings on the front faces of the helmet which could also admit rain, moisture or other contaminants. The external heat sink more effectively dissipates heat than prior art helmet cooling systems allowing the use of only a single blower fan in some embodiments and allowing the effective cooling by a Peltier type element which is powered from a simple twelve volt DC power source. The helmet can be provided with an internal blower fan and a curved, low profile heat sink which follows the contours of the helmet and which presents a pleasing aerodynamic aspect. Because the internal components are fitted within the styrofoam liner of the helmet, they are easily accessible for repair or replacement. The air conditioning system of the invention can be provided in kit form whereby a user can install the air conditioning components in a stock crash helmet. It is generally necessary only to make two openings in the existing rigid shell of a stock helmet. The internal styrofoam liner can be removed and ducts and openings can be provided in the liner to house the internal components of the system and route air conditioned air to the head receiving cavity in the interior of the helmet.

While the invention has been shown in only one of its forms, it is not thus limited but is susceptible to various changes and modifications without departing from the spirit thereof.

What is claimed is:

1. An air conditioned crash helmet, comprising:

an impact resistant body having an exterior, an interior which defines a head receiving cavity, a front region and having a back region which is located adjacent a lower edge of the helmet body;

a first opening in the helmet body located at the back region of the helmet body adjacent the lower edge thereof, the first opening defining an air intake passage for the intake of external air;

at least one blower fan communicating with the air intake passage for drawing air into the intake passage and forcing the air from the back region of the helmet in the direction of the front region thereof;

a thermoelectric cooling element located in the helmet interior in communication with the intake passage downstream of the blower fan, the thermoelectric cooling element having a cold side and a hot side;

a power source for powering the thermoelectric cooling element;

an external heat sink located on the helmet exterior, the external heat sink being connected to the hot side of the thermoelectric cooling element by means of a second opening in the helmet body.

2. The crash helmet of claim 1, wherein the helmet interior has a styrofoam liner installed therein and wherein the liner has a plurality of air conditioning ducts formed therein in communication with the air intake passage, whereby air forced from the rear of the helmet through the air intake passage is forced through the air conditioning ducts into the head receiving cavity in the interior of the helmet body.

3. The crash helmet of claim 2, wherein the thermoelectric cooling element is a Peltier cooling element.

4. The crash helmet of claim 3, wherein the external heat sink located on the helmet exterior is a thin, curved strip having a length and a width and which wraps around a portion of the helmet exterior extending from the back region of the helmet body toward the front.

5. The crash helmet of claim 4, wherein the external heat sink has a length which is at least twice its width.

6. The crash helmet of claim 5, wherein the power source for the thermoelectric cooling element is a cigarette lighter adapter which allows the thermoelectric cooling element to be connected to a source of DC power.

7. The crash helmet of claim 1, wherein the helmet body is devoid of any air intake openings in the front of the helmet body.

8. An air conditioned crash helmet, comprising:

an impact resistant body having an exterior, an interior which defines a head receiving cavity, a front region and having a back region which is located adjacent a lower edge of the helmet body;

a first opening in the helmet body located at the back region of the helmet body adjacent the lower edge thereof, the first opening defining an air intake passage for the intake of external air;

a volute formed on the back region of the helmet body adjacent the lower edge thereof, the volute housing at least one blower fan which communicates with the air intake passage for drawing air into the intake passage and forcing the air from the back region of the helmet in the direction of the front region thereof;

a thermoelectric cooling element located in the helmet interior in communication with the intake passage downstream of the blower fan, the thermoelectric cooling element having a cold side and a hot side;

a power source for powering the thermoelectric cooling element;

an external heat sink located on the helmet exterior, the external heat sink being connected to the hot side of the thermoelectric cooling element by means of a second opening in the helmet body.

9. The crash helmet of claim 8, wherein the helmet interior has a styrofoam liner installed therein and wherein the liner has a plurality of air conditioning ducts formed therein in communication with the air intake passage, whereby air forced from the rear of the helmet through the air intake passage is forced through the air conditioning ducts into the head receiving cavity in the interior of the helmet body.

10. The crash helmet of claim 9, wherein the thermoelectric cooling element is a Peltier cooling element.

11. The crash helmet of claim 10, wherein the external heat sink located on the helmet exterior is a thin, curved strip having a length and a width and which wraps around a portion of the helmet exterior extending from the back region of the helmet body toward the front.

12. The crash helmet of claim 11, wherein the external heat sink has a length which is at least twice its width.

13. The crash helmet of claim 12, wherein the power source for the thermoelectric cooling element is a cigarette lighter adapter which allows the thermoelectric cooling element to be connected to a source of DC power.

14. The crash helmet of claim 9, wherein the helmet body is devoid of any air intake openings in the front of the helmet body.

15. A method of air conditioning a stock crash helmet, the helmet having an impact resistant body with a styrofoam interior liner, the helmet having an exterior, an interior which defines a head receiving cavity, a front region and having a back region which is located adjacent a lower edge of the helmet body, the method comprising the steps of:

providing a first opening in the helmet body located at the back region of the helmet body adjacent the lower edge thereof, the first opening defining an air intake passage for the intake of external air;

providing a second opening in the helmet body located forward of the first opening and spaced apart a selected distance therefrom;

removing the styrofoam liner from the helmet interior and forming an intake passage and a plurality of connected air conditioning ducts therein, the air intake passage being arranged to communicate with the first opening and the air conditioning ducts being arranged to communicate with the interior of the helmet in the head receiving region;

providing at least one blower fan communicating with the air intake passage for drawing air into the intake passage and forcing the air from the back region of the helmet in the direction of the front region thereof when the liner is reinstalled into the helmet interior;

providing a thermoelectric cooling element located in the helmet interior in communication with the intake passage downstream of the blower fan, the thermoelectric cooling element having a cold side and a hot side;

providing a power source for powering the thermoelectric cooling element;

mounting an external heat sink on the helmet exterior, the external heat sink being connected to the hot side of the thermoelectric cooling element by means of the second opening in the helmet body;

reinstalling the styrofoam helmet liner and connecting the blower fan, thermoelectric cooling element and heat sink and powering the cooling element to thereby force air from the intake passage through the air conditioning ducts to the head receiving region on the interior of the helmet body.

16. The method of claim 15, wherein the thermoelectric cooling element is a Peltier element which is powered from a cigarette adapter which is connected by a cable between a DC power source and the element.

17. The method of claim 16, wherein the external heat sink which is located on the helmet exterior is provided in the form of a thin, curved strip having a length and a width, the strip being wrapped around a portion of the helmet exterior extending from the back region of the helmet body toward the front.

18. The method of claim 17, wherein the external heat sink has a length which is at least twice its width.

* * * * *